US005620369A

United States Patent [19]

Spransy et al.

[11] Patent Number: 5,620,369

[45] Date of Patent: Apr. 15, 1997

[54] METHOD AND DEVICE FOR UNIDIRECTIONAL AIRFLOW IN CLEANROOM

[75] Inventors: Peter J. Spransy, Salt Lake City; Ronald W. Daw, Murray; David L. Brewer, Sandy, all of Utah

[73] Assignee: Daw Technologies, Inc., Salt Lake City, Utah

[21] Appl. No.: 465,745

[22] Filed: Jun. 6, 1995

Related U.S. Application Data

[63] Continuation of Ser. No. 216,209, Mar. 22, 1994, abandoned.

[51] Int. Cl.[6] ..... F24F 13/068

[52] U.S. Cl. ..... 454/187; 55/355; 55/484; 454/295

[58] Field of Search ..... 454/187, 293, 454/294, 295; 55/355, 385.2, 484

[56] References Cited

U.S. PATENT DOCUMENTS

| | | | |
|---|---|---|---|
| 3,158,457 | 11/1964 | Whitfield . | |
| 3,173,616 | 3/1965 | Lipscomb . | |
| 3,638,404 | 2/1972 | Moll et al. . | |
| 4,175,281 | 11/1979 | Lonseth . | |
| 4,667,579 | 5/1987 | Daw . | |
| 4,693,175 | 9/1987 | Hashimoto . | |
| 4,917,004 | 4/1990 | Okamoto et al. | 454/187 |
| 5,192,348 | 3/1993 | Ludwig | 454/187 |

FOREIGN PATENT DOCUMENTS

| | | | |
|---|---|---|---|
| 0207027 | 12/1986 | European Pat. Off. . | |
| 2293233 | 7/1976 | France . | |
| 2417678 | 10/1975 | Germany | 454/294 |
| 138635 | 6/1987 | Japan | 454/187 |

*Primary Examiner*—Harold Joyce
*Attorney, Agent, or Firm*—Trask, Britt & Rossa

[57] ABSTRACT

A ceiling structure within a cleanroom, including an array of cleanroom filters supported in openings of a grid support structure, wherein the ceiling structure includes a gel track coupled either at the top of the grid support channel. The cleanroom filters including a peripheral flange are suspended in the ceiling structure by having a ceiling edge of the peripheral flange either immersed in the gel track at the top of the grid support structure or using a cleanroom filter having gel or the lower knife edge seal thereof engaging a portion of the top of the grid support channel. Filtered air passes through the channel structure into the vortex region to reduce the vortex region or dead air space below the channel as well as prevent the accumulation of particulate material in the interior of the channel. A damper may be provided with the grid support structure to control the flow of filtered air into the interior of the grid support structure.

12 Claims, 5 Drawing Sheets

METHOD AND DEVICE FOR UNIDIRECTIONAL AIRFLOW IN CLEANROOM

This application is a application of Ser. No. 08/216,209, filed Mar. 20, 1994 abandoned.

BACKGROUND OF THE INVENTION

1. Field of the Invention

The present invention relates to cleanroom construction and particularly to cleanroom ceilings and frames therefor, including the mounting of ceiling panels and cleanroom air filters on supporting beams or cross members and the suspension of lighting fixtures, wire conduits, or other hardware from the cross members between the filters. More particularly, the present invention relates to a ceiling structure which eliminates the vortex formations formed below the cross members and improves the airflow in a cleanroom for more uniform, unidirectional laminar flow therein by directing airflow through the ceiling structure.

2. State of the Art

The Electronics industry has imposed ever more rigorous purity requirements on cleanrooms where sensitive components are manufactured. Several years ago, class 100 cleanrooms (averaging no more than 100 particles of 0.5 microns diameter in one cubic foot of controlled air space) were acceptable, while requirements today often exceed class 1 based on 0.1 micron diameter particles. See, for example, prior art patents disclosing cleanroom structures include U.S. Pat. Nos. 3,158,457; 3,638,404; 4,667,579 and 4,693,173. Cleanroom ceilings, walls, and floors must therefore be constructed in such a manner as to minimize convection and eddy currents, dead air spots, and other areas which tend to collect dust and other particulate matter and/or disturb the uniform airflow in the cleanroom. Because of the moving air within the cleanroom, both convection currents and dead spots tend to form small, swirling pockets of air near the ceiling, referred to herein generally as vortices. These pockets capture and accumulate particulate material.

Generally, cleanrooms require filtered airflow and/or the uniform flow of filtered air from the ceiling to and through the floor. The airflow originates from blowers situated between the cleanroom and the filters. The air from the blowers is forced through cleanroom air filters overlaying a portion of, or the entire ceiling of, the cleanroom and travels downwardly from the ceiling through the cleanroom, exiting through the floor. The ceiling filters are generally mounted on a grid of ceiling support beams or cross members, the bottom surfaces of which may be in close proximity with the bottom surfaces of the filters.

Although the diffusion screen assists in developing laminar flow of the air exiting the filters, the desired uniform flow pattern is interrupted immediately below the ceiling surface by vortex regions and dead air space beneath the cross members. These vortex regions form because of low pressure arising below the cross members in the absence of airflow, causing a dead space where particulate material can accumulate. The size and geometry of the vortex will vary, depending upon the width of the cross member and the velocity of airflow emanating from the adjacent filters.

The uniform flow pattern is also disturbed by light fixtures and other attachments which are suspended from the cross members. For example, the high intensity lighting systems used in cleanrooms generally comprise extended linear arrays of fluorescent light tubes traversing the width and/or length of the cleanroom ceiling. The bottom surfaces of the support beams generally are used for the attachment of these light fixtures and are also used to attach mounting apparatuses for supporting modular walls and similar hardware. These attachments extend into the cleanroom from the ceiling plane formed by the ceiling filters and beams, creating convection currents and collection points for particulate matter which impair the purity of the cleanroom.

In the past, efforts to place these light fixtures within the cross members have been frustrated by the need for minimizing the vortex and dead air space present under the width of the cross member. Placement of the light fixture within the cross member would necessarily increase this width in order to provide adequate volume to fully contain the fixture. Accordingly, a typical practice continues the use of tear drop configuration of lights which suspends the fixture below the cross member.

Nevertheless, the increasingly stringent requirements for minimal contamination within the cleanroom requires modification of cleanroom ceiling structure to a flush mounted system. Referring to drawing FIG. 2, the Brod McClung-Pace Co. has introduced a flush ceiling system which depicts a widened cross member 10 having an enlarged channel 11 for receiving a light fixture 12. A gel track 13 supports cleanroom filters 14 in a position located above the channel 11. A screen member 20 is attached below the filter 14 in a manner which is represented to have reduced the vortex region 16 under the cross member to within 2 inches of the flush surface 17. Typically, a vortex and any non-uniform velocity area will extend 3 to 4 times the grid width. The actual depth of the vortex associated with the Pace system is suggested to be only one-half the distance between adjacent filters.

Another point of concern is that no suitable arrangement of cleanroom ceiling fixture attachments has yet been developed which maximizes uniformity of noncontaminated airflow while at the same time offering compatibility with conventional cleanroom ceiling structure such as conventional cleanroom filters with a lower mounting flange or knife edge positioned at the base of the filter while minimizing or eliminating vortex formations and dead air spaces. The Pace "under slung" structure requires use of a special filter 14 whose mounting flange 15 is positioned at an upper portion 19 of the filter. Such compatibility with conventional low mounting flange or knife edge structure is not only important from a viewpoint of economy in construction, but the conventional filter with lower mounting flange offers a known advantage of better sealing which is known and trusted within the industry. Any use of a non-HEPA standard filter only results in industry resistance to the arrangement as well as such as arrangement being viewed as inferior or undesirable by the industry. Accordingly, the use of conventional cleanroom filters avoids such problems.

Neither has such a system been developed for general use with flush lighting systems in ceilings of non-cleanroom environments, e.g., Lonseth, U.S. Pat. No. 4,175,281, Lipscomb, U.S. Pat. No. 3,173,616.

In U.S. patent application Ser. No. 07/973,067, filed Nov. 6, 1992, the assignee of the present invention discloses and illustrates a ceiling structure within a cleanroom which includes an array of standard cleanroom filters supported in grid support structure approximately flush with an exposed surface of the cleanroom filters to the cleanroom interior. Means are provided for flushing a vortex space immediately below the grid support structure and between the respective openings of the grid structure with a channeled air stream to remove particulate contaminant.

One prior art embodiment of the '067 patent application which uses a standard cleanroom filter with a knife edge seal at the bottom is illustrated in drawing FIG. 3. This embodiment provides a cross member 33 having a top wall 35 and opposing side walls 36 and 37. These side walls extend down to a gel track 38.

This gel track 38 is accordingly coupled to the cross member by being integrally formed as a single extrusion with the side walls 36 and 37 near a lowest interior perimeter of each of the openings 32 in the grid support structure.

The function of the gel track 38 is to provide a trough for containment of a sealing gel which receives a peripheral flange or knife edge 44 which is coupled to and supports the cleanroom filter material 45. This peripheral flange 44 includes a sealing edge 46 which is suspended within the gel track in near proximity with the ceiling level 50.

The inside, side walls 36*a* and 37*a* form a vertical extension of the respective side walls 36 and 37 and provide a mounting base for integral attachment of the base side 39, 40 and remaining inclined side walls 41 and 42.

This inclined side wall structure which provides means for flushing a vortex space or region (referred to hereafter as vortex) 51.

The specific purpose of the inclined side wall structure is to provide means for generating a stream of airflow 52 toward this vortex 51 which effectively sweeps particulate matter into a desired laminar flow with the remaining airflow generated through the grid openings.

A screen is mounted with respect to the gel track and filter support structure 66 by means of a second peripheral flange 67, forming a "Z" configuration.

Another embodiment of the '067 patent application is illustrated in drawing FIG. 4 and shows a perimeter wall structure 73 which provides an angled Z configuration. This angled Z is formed at its base by the perforated screen 71 and couples to a first perimeter wall 72 of the screen which is substantially parallel with the inclined wall 74 of the gel track. The space between the first perimeter wall 72 and inclined wall 74 forms the flow channel. The remaining angled Z structure includes a section of screen wall 75 comprising an upper inclination cooperates with the peripheral flange structure 72 and 75, and openings 78 to direct airflow toward the vortex space.

While these embodiments provide an improved airflow distribution and reduce the size of any disturbance or vortex formation below the sealed lighting area of the ceiling grid, it is desirable to eliminate the disturbance area or vortex below the lighting area to provide laminar, unidirectional airflow throughout the cleanroom.

SUMMARY OF THE INVENTION

The present invention relates to a ceiling structure for a cleanroom which reduces the vortex formations formed below the cross members and improves the airflow in a cleanroom for more uniform, unidirectional, laminar flow therein. The ceiling structure of the present invention comprises a structural channel having gel tracks thereon, standard cleanroom filters having a peripheral flange engaging the channel gel tracks, and means for directing filtered airflow through the cavity in the structural channel to sweep the interior of the structural channel with filtered air and reduce the area of vortex flow or flow disturbance below the structural channel thereby improving the uniform, unidirectional, laminar airflow in the cleanroom.

The ceiling structure of the present invention comprises an array of standard cleanroom filters supported in openings of a grid structure which structure includes a gel track near the interior perimeter of each opening in the grid support structure, each standard cleanroom filter including a peripheral flange suspended with the gel track, and controlled variable flow area apertures in the grid structure for allowing air exiting the standard cleanroom filters to flow through the grid support structure into the cleanroom.

The present invention also contemplates a method for preventing accumulation of particulate material from a vortex space immediately below cross members having a plurality of apertures therein forming a grid matrix which supports standard cleanroom filters above a cleanroom, the method comprising the steps of suspending the standard cleanroom filter within openings in the grid matrix and between cross members, positioning a screen below the cleanroom filter to form a pressure chamber, and forcing air through the standard cleanroom filter into the pressure chamber with the airflow therefrom passing into the channel, the interior of said cross members as well as through a screen diffuser into the cleanroom.

DETAILED DESCRIPTION OF PREFERRED EMBODIMENT

The present invention will be better understood when the drawings are taken in conjunction with the detailed description of the invention.

Figure 1:
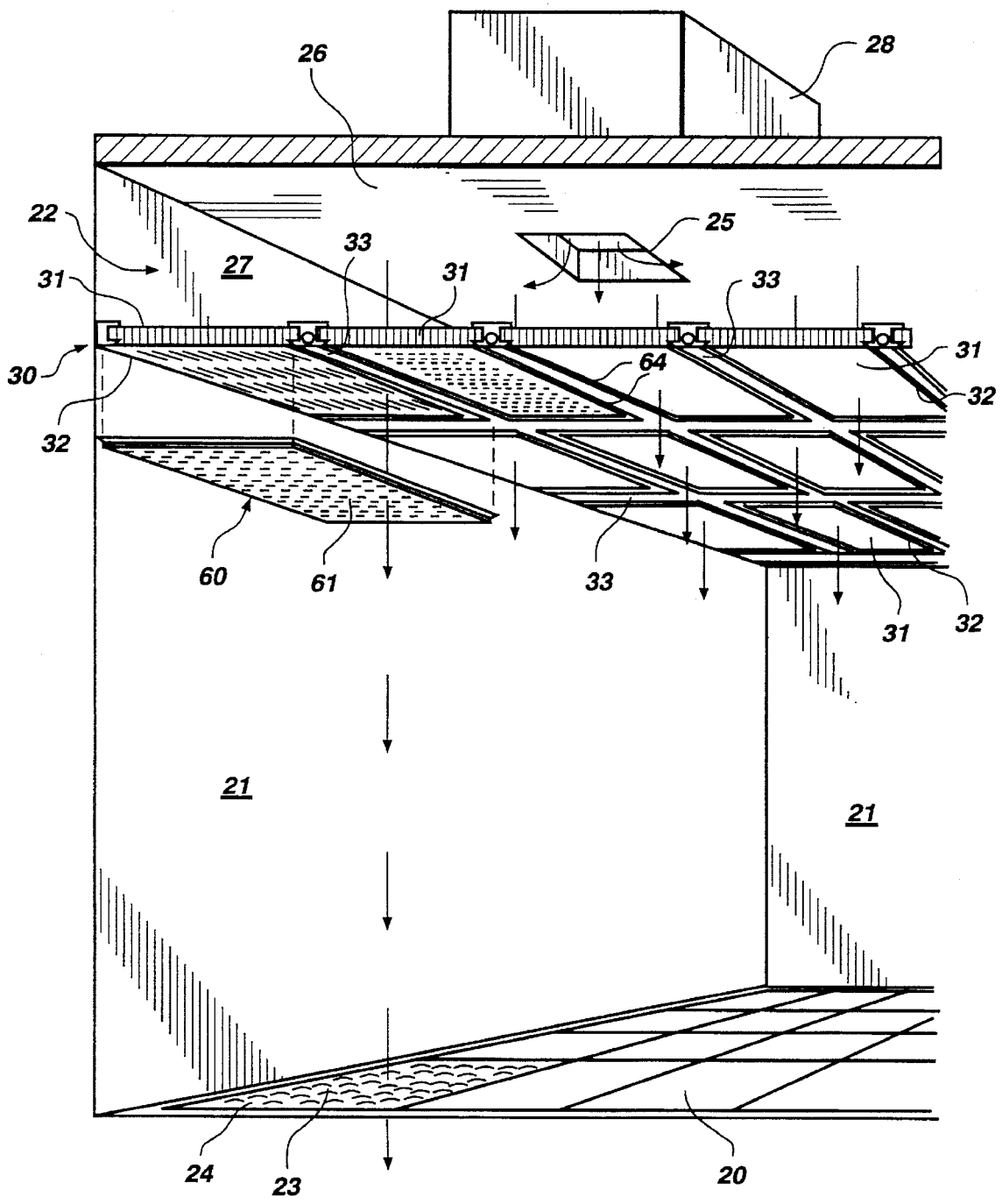
FIG. 1 shows a cutaway, perspective view of a cleanroom illustrating a flush light mounted ceiling with a cleanroom filter structure.
Figure 2:
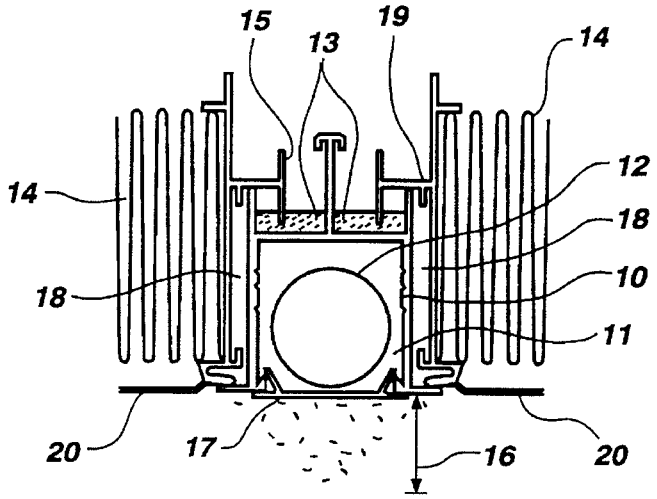
Fig. 2 (PRIOR ART)
FIG. 2 is a cross-sectional view of a prior art construction showing vortex areas therebelow.
Figure 3:
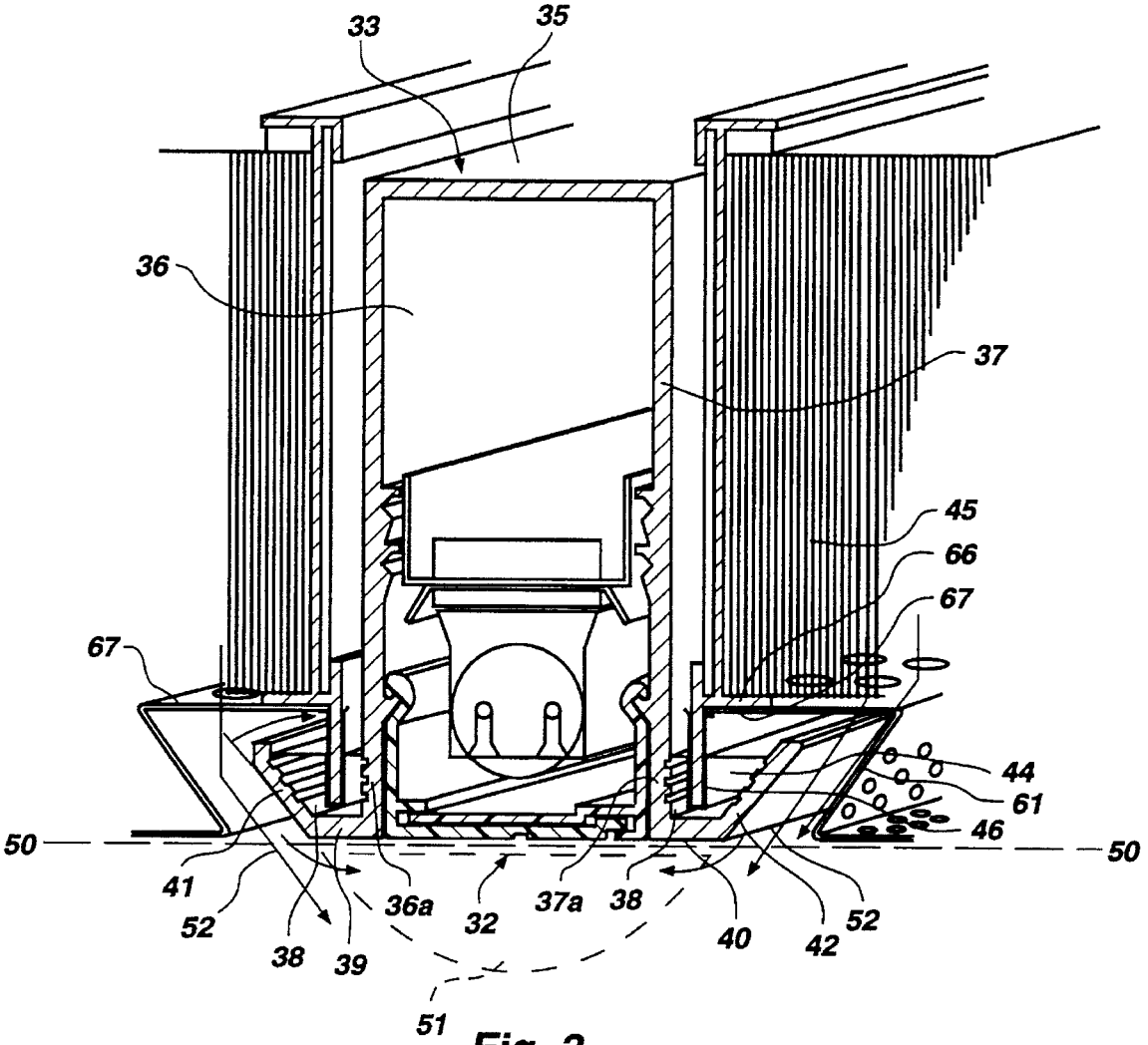
Fig. 3 (PRIOR ART)
FIG. 3 is a cross-sectional view of a prior art construction which minimizes the vortex areas therebelow.
Figure 4:
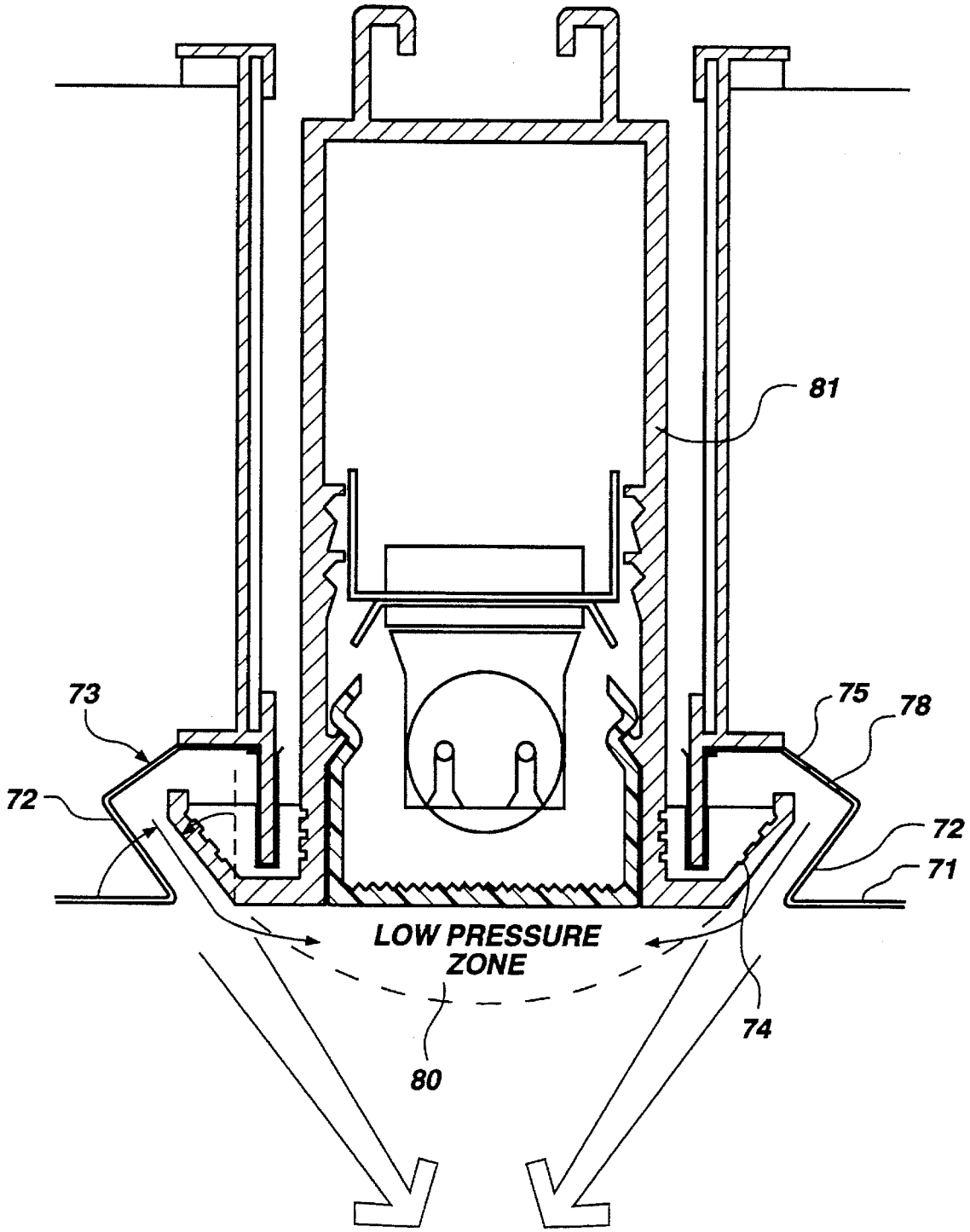
Fig. 4 (PRIOR ART)
FIG. 4 is a cross-sectional view of a prior art construction which minimizes the vortex areas therebelow.

Referring to drawing FIG. 1, a cleanroom of conventional enclosure including floor structure 20, side walls 21 and an overhead plenum 22 is shown. The floor structure 20 is a grid construction which is vented to allow airflow therethrough. This airflow may either be recirculated to the plenum or exhausted to the atmosphere. Although openings 23 are shown in only one grid section 24, it is to be understood that in general applications, all grid sections in the area where uniform airflow is desired will provide for venting of air to facilitate a uniform, unidirectional laminar airflow pattern from the plenum 22 to and through the floor 20.

Plenum 22 and side wall construction has not been detailed, but merely represents conventional enclosure structure which provides maximum sealing to achieve desired cleanroom conditions. This enclosing structure may be either floor supported or otherwise suspended. The plenum 22 or cleanroom filter having a hood (not shown) receives air through a plenum opening 25 or duct (not shown) which may either be in the top covering 26 or in lateral walls 27 or where desired. In the interest of simplicity, other structures applied within the plenum 22 for support and for dispersion of airflow have not been shown. For example, a baffle plate or other air distribution structure would typically be positioned within the plenum to provide dispersion of air pressure throughout the plenum volume. An air handling unit 28 is coupled to the opening 25 and supplies air to pressurize the plenum. Here again, numerous systems for air control are available and may be applied with conventional techniques to service a cleanroom in accordance with the present invention.

A flush mounted ceiling structure 30 includes an array of cleanroom filters 31 which are supported in openings 32 of a grid support structure 33. The details of construction for the grid support structure and its associated components making up the cleanroom ceiling are shown more clearly in drawing FIGS. 5 and 6.

The cross members 33 form a grid matrix and supply the load bearing component to support the total ceiling structure 30, including the cleanroom filters which are suspended within the grid openings 32. Typically, the cross members which make up the grid structure are extruded aluminum sections rigidly interconnected and are capable of supporting the ceiling structure.

Figure 5:
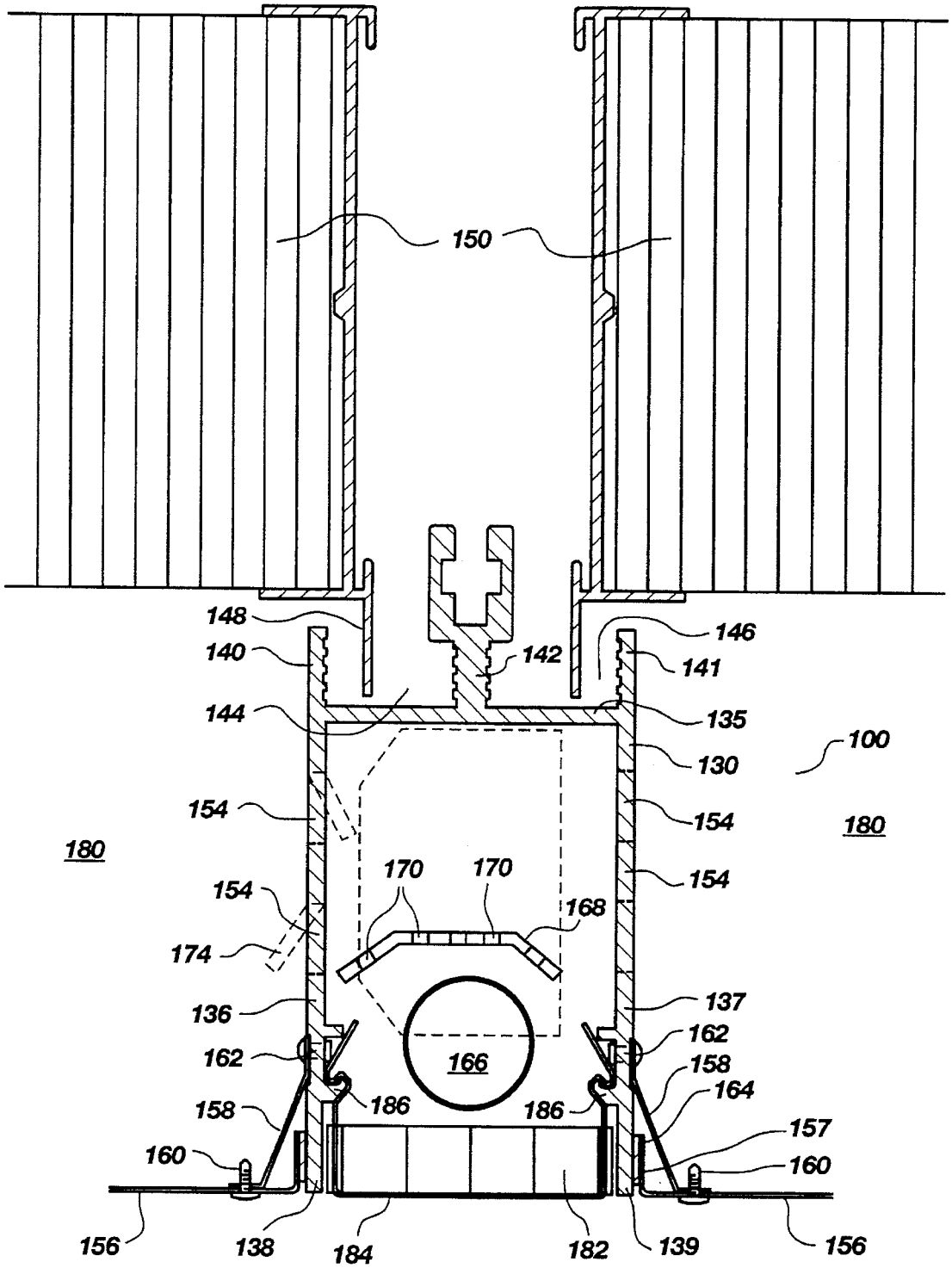
FIG. 5 is a cross-sectional view of a first embodiment of the present invention.

Referring to drawing FIG. 5 a first embodiment 100 is shown having a cross member 130 having top wall 135, opposing side walls 136 and 137, and lower wall portions 138 and 139. Extending upwardly from top wall 135 are upper opposing side walls 140 and 141 as well as center wall 142. Located between opposing side walls 140 and 141 and center wall 142 are gel tracks 144 and 146.

The gel tracks 144 and 146 is to provide a trough for containment of a sealing gel which receives a peripheral flange or knife edge 148 connected to cleanroom filter material 150.

Formed in opposing side walls 136 and 137 are apertures 154. The apertures 154 may be of various shapes, sizes, numbers, or rows of apertures, such as circular apertures, slots, angled circular apertures, etc., provided that the apertures 154 allow the ready, balanced, uniform velocity flow of filtered air therethrough.

Engaging opposing side walls 136 and 137 are screen diffusers 156. Each screen diffuser 156 comprises a large planar screen having a uniform distribution of perforations which enhance the unidirectional laminar flow of air exiting the air filters 150. Each screen diffuser 156 includes angular wall 157 portions which are parallel to lower wall portions 138 and 139.

Shown schematically in the channel are elongated lamp 166 and reflector 168 having a plurality of apertures 170 therein. The apertures 170 may be of any desired size or shape provided that filtered air can readily flow therethrough and around elongated lamp 166.

Shown in the area between the bottom of each filter 150 and screen diffuser 156 is plenum 180 wherein filtered air exiting the filter 150 flows to equalize the velocity thereof before flowing through screen diffuser 156 and into channels 130 via apertures 154 therein.

If desired, side walls 136 and 137 may contain pierced apertures having deformed members 174 (shown in phantom) extending into the channel. The deformed members 174 may be of any shape or size or deformed inwardly or outwardly at any desired angle or any desired member. Also, if desired, the reflectors 168 may be eliminated and the interior of the channel 130 painted, coated or plated with a suitable reflective material to reflect light from the elongated lamp 166 downwardly.

The screen diffusers 156 are releasably secured to the channel 130 to the lower portions 138 and 139 of opposing side walls 136 and 137 respectively via straps 158 having one end thereof secured to the screen diffuser via threaded fastener 160 and the other end thereof secured to channel 130 via suitable fastener 162, such as a rivet, bolt, screw, etc. If desired, the periphery of each screen diffuser 156 may include a suitable isolation gasket 164 between the edge 166 of the screen diffuser 156 and the lower wall portions 138 and 139 of structural channel 130.

Further illustrated in drawing FIG. 5 is an egg-crate light diffuser 182 releasably retained in the bottom of channel 130. The egg-crate light diffuser 182 is releasably retained in the bottom of channel 130 via spring wire clips 184 having each end thereof resiliently engaging longitudinal rib 186 formed on the interior of each opposing walls 136 and 137.

Figure 6:
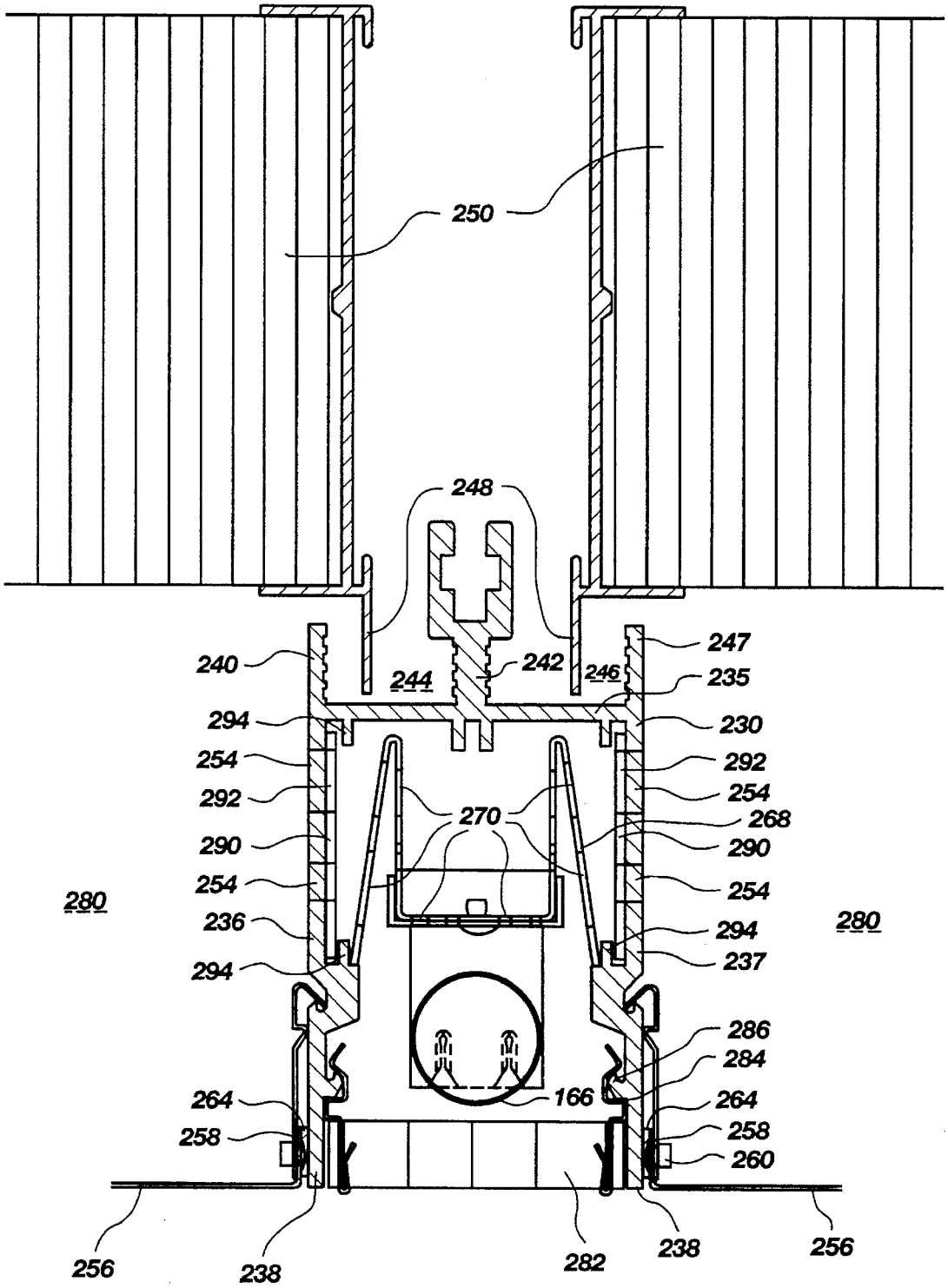
FIG. 6 is a cross-sectional view of a second embodiment of the present invention.

Referring to drawing FIG. 6, a second embodiment 200 is shown having a cross member 230 having top wall 235, opposing side walls 236 and 237, and lower wall portions 238 and 239. Extending upwardly from top wall 235 are upper opposing side walls 240 and 241 as well as center wall 242. Located between opposing side walls 240 and 241 and center wall 242 are gel tracks 244 and 246.

The gel tracks 244 and 246 are to provide a trough for containment of a sealing gel which receives a peripheral flange or knife edge 248 connected to cleanroom filter material 250. Alternately, a cleanroom filter 250 may be used which includes gel on the knife edge 248.

Formed in opposing side walls 236 and 237 are apertures 254. The apertures 254 may be of various shapes, sizes, numbers, or rows of apertures, such as circular apertures, slots, angled circular apertures, etc., provided that the apertures 254 allow the ready, balanced, uniform velocity flow of filtered air therethrough.

Engaging opposing side walls 236 and 237 are screen diffuses 256. Each screen diffuser 256 comprises a large planar screen having a uniform distribution of perforations which enhance the unidirectional laminar flow of air exiting the air filters 250. Each screen diffuser 256 includes portion 258 which are parallel to lower wall portions 238 and 239.

Shown schematically in the channel are elongated lamp 166 and reflector 268 having a plurality of apertures 270 therein. The apertures 270 may be of various desired sizes or shapes provided that filtered air can readily flow therethrough and around elongated lamp 266.

Shown in the area between the bottom of each filter 250 and screen diffuser 256 is pressure chamber 280 wherein filtered air exiting the filter 250 flows to equalize the velocity thereof before flowing through screen diffuser 256 and into channels 230 via apertures 254 therein.

If desired, side walls 236 and 237 may contain pierced apertures, as described hereinbefore, having deformed members extending into the channel. The deformed members may be of various sizes or deformed inwardly or outwardly at any desired angle or any desired member. Also, if desired, the reflectors 268 may be eliminated with lamp 266 being attached by a fastener to top wall 235 and the interior of the channel 230 painted, coated or plated with a suitable reflective material to reflect light from the elongated lamp 166 downwardly.

The screen diffusers 256 are releasably secured to the channel 230 to the lower portions 238 and 239 of opposing side walls 236 and 237 respectively via resilient clips 258 having one end thereof secured to the screen diffuser via threaded fastener 260 and the other end thereof resiliently secured to an exterior portion of channel 230. If desired, the periphery of each screen diffuser 256 may include a suitable isolation gasket 264 between the edge 258 of the screen diffuser 256 and the lower wall portions 238 and 239 of structural channel 230.

Further illustrated in drawing FIB. 6 is an egg-crate light diffuser 282 releasably retained in the bottom of channel 230. The egg-crate light diffuser 282 is releasably retained in the bottom of channel 230 via spring wire clips 284 having each end thereof resiliently engaging longitudinal rib 286 formed on the interior of each opposing wall 236 and 237.

Also illustrated in drawing FIG. 6 are longitudinally slidable dampers 290 having apertures 292 therein. The dampers 290 are slidably, movably retained within the channel 230 between vertically extending ledges 294 on the interior of the channel 230. The dampers 290 may be formed of various suitable materials which will readily slide with minimal friction within the ledges 294 of channel 230 to provide a control over the filtered airflow entering the interior of channel 230 via apertures 254. In this manner the velocity of the filtered airflow through the channel 230 may be controlled.

OPERATION OF THE INVENTION

Referring to drawing FIG. 5, air flows through cleanroom filters 150 into the pressure chamber 180 formed therebelow and above screen diffuser 156. In the pressure chamber 180 the filtered airflow tends to stabilize and reduce velocity differentials which may be present. From pressure chamber 180 filtered air flows through screen diffuser 156 into the cleanroom, through apertures 154 in opposing side walls 136 and 137 into the interior of channel 130, and through apertures 170 in light diffuser 168 past elongated lamp 166 into the cleanroom. In this manner, any vortex, reduced air flow velocity area, or dead air area, below the elongated lamp 166 and channel 130 is minimized, reduced, or completely eliminated thereby creating a more uniform, unidirectional laminar flow from the ceiling of the cleanroom to the floor thereof.

By selecting the appropriate size and number of the apertures 154 and 170 as well as the size and number of apertures in the screen diffusers 156, the airflow velocity distribution can be substantially uniform or of very low variation. Also, the channels 130 offer the advantage that filtered air is used to continuously sweep the interior of the channels to minimize the collection of particulate material therein.

Referring to drawing FIG. 6, the filtered airflow is similar to that described in drawing FIG. 5. The filtered airflow in the channel 230 may be controlled by sliding the dampers 290 to either cover or expose greater flow area for the filtered airflow through the apertures 254. In this manner, greater or enhanced control over the filtered airflow into the channel 230 is provided to eliminate uneven airflow velocities in the cleanroom below the ceiling.

It will be obvious to those of ordinary skill in the art that various modifications, changes, substitutions, or deletions can be made to the present invention which fall within the scope thereof. For instance, the lamp 166 may be suspended in differing manners, the reflector and manner of attachment may be varied, the attachment of the screen diffusers to the channel may be varied, such as using fasteners rather than resilient clips, etc.

What is claimed is:

1. A ceiling structure forming a ceiling within a cleanroom, said ceiling structure including a grid support structure forming rectangular openings in said ceiling structure and an array of cleanroom filters formed by a plurality of rectangular filters, each rectangular filter of said plurality of rectangular filters having an upper surface, lower surface, and a periphery supported above said rectangular openings foraged by said grid support structure of said ceiling structure, said plurality of cleanroom filters filtering air flowing into said cleanroom, said grid support structure including:

a plurality of crossmembers forming said rectangular openings in said grid support structure, the plurality of crossmembers supplying the load bearing support for said ceiling structure, each crossmember of the plurality of crossmembers including:

a crossmember having a top wall, a first side wall having at least one aperture therein to allow a portion of said air exiting said rectangular filters to flow therethrough into the crossmember, a second side wall having at least one aperture therein to allow a portion of said air exiting said rectangular filters to flow therethrough into the crossmember, and a gel track formed proximate the top wall of each crossmember of the plurality of crossmembers of said grid support structure forming said rectangular openings and formed near said perimeter of each of said rectangular openings in said grid support structure of said ceiling within said cleanroom formed by the plurality of crossmembers;

each rectangular cleanroom filter of said rectangular cleanroom filters including an upper surface, a lower surface, a periphery, and a peripheral flange located proximate the lower surface and extending about the periphery, the peripheral flange having a sealing edge extending proximate the lower surface of each of said rectangular cleanroom filters substantially about the periphery thereof suspended within the gel track in sealing engagement therewith formed by the plurality of crossmembers forming the grid support structure for said ceiling structure; and at least one elongated light installed within at least a potion of one crossmember having said at least one aperture in the first side wall thereof and said at least one aperture in the second side wall thereof of said grid support structure thereby allowing the portion of said air flowing through the at least one aperture in the first side wall and the at least one aperture in the second side wall in said at least one crossmember of said plurality crossmembers of said grid support structure to flow therearound thereby exiting said at least one crossmember of said plurality of crossmembers of said grid support structure.

2. A structure as defined in claim 1, further including: an elongated open light diffuser located proximate the bottom of said grid support structure for allowing the air exiting said cleanroom filters to flow through said grid support structure into said cleanroom.

3. A structure as defined in claim 2, further including:

resilient attachment means for releasably securing the open light diffuser to said grid support structure.

4. A structure as defined in claim 1, further including:

screen diffuser apparatus located below each cleanroom filter of said array of cleanroom filters; and an isolation seal located between the outer periphery of each screen diffuser means and the grid support structure.

5. The structure as defined in claim 4, wherein the screen diffuser apparatus are supported by said grid support structure.

6. A ceiling structure forming a ceiling within a cleanroom, said ceiling structure including a grid support structure forming rectangular openings in said ceiling structure and an array of cleanroom filters formed by a plurality of rectangular filters, each rectangular filter of said plurality of rectangular filters having an upper surface, lower surface, and a periphery supported above said rectangular openings formed by said grid support structure of said ceiling structure, said plurality of cleanroom filters filtering air flowing into said cleanroom, said grid support structure including:

a plurality of crossmembers forming said rectangular openings in said grid support structure, the plurality of crossmembers supplying the load bearing support for said ceiling structure, each crossmember of the plurality of crossmembers including:

a crossmember having a top wall, a first side wall having at least one aperture therein to allow said air to flow therethrough, and a second side wall having at least one aperture therein to allow Said air to flow therethrough;

a gel track formed proximate the top wall of each crossmember of the plurality of crossmembers of said grid support structure forming said rectangular openings and formed near said perimeter of each of said rectangular openings in said grid support structure of said ceiling within said cleanroom formed by the plurality of crossmembers;

each rectangular cleanroom filter of said rectangular cleanroom filters including an upper surface, a lower surface, a periphery, and a peripheral flange extending about the periphery, the peripheral flange having a sealing edge extending substantially about the periphery thereof being suspended within the gel track in sealing engagement therewith formed by the plurality of crossmembers forming the grid support structure for said ceiling structure thereby preventing the flow of said air therethrough;

at least one elongated light installed within at least a portion of one crossmember having at least one aperture in the first side wall thereof and at least one aperture in the second side wall thereof of said grid support structure thereby allowing the portion of said air flowing through the at least one aperture in the first side wall and the at least one aperture in the second side wall in said grid support structure to flow therearound thereby exiting said at least a portion of one crossmember of said plurality of crossmembers of said grid support structure; and damper apparatus movable within said support structure to vary the open area of the at least one aperture in the first side wall and the at least one aperture in the second side wall of one crossmember of the plurality of cross members of in the grid support structure.

7. A cleanroom ceiling for a cleanroom, said cleanroom ceiling comprising an array of rectangular cleanroom filters supported within a grid support system, each rectangular cleanroom filter of said array having a filter support flange extending about the periphery thereof, said array of cleanroom filters filtering air flowing into said cleanroom, said grid support system including:

a rectangular matrix formed by a plurality of interconnected load bearing cross members providing load bearing support to said cleanroom ceiling structure, the plurality of cross members forming a plurality of rectangular filter insert openings between adjacent cross members, each load bearing cross member of the plurality of cross members including:

a crossmember having a top wall, a first side wall having at least one aperture therein to allow a portion of said air to flow therethrough, and a second side wall having at least one aperture therein to allow a portion of said air to flow therethrough;

a gel track support channel formed proximate the top of each load bearing cross member to receive a portion of said filter support flange within the gel track support channel; and one or more elongated lights installed within the cross members and allowing air exiting the aperture in the first side wall thereof and the second side wall thereof of the cross member of the plurality of cross members to flow therearound and exit the cross members into the vortex space therebelow.

8. A structure as defined in claim 7, further comprising a diffuser screen positioned below each rectangular insert filter opening of the rectangular filter insert opeings and approximately flush with the bottom surfaces of the cross members.

9. A method for preventing accumulation of particulate material from a vortex or dead air space immediately below cross members forming a grid matrix which supports cleanroom filters above a cleanroom enclosure, said method comprising the steps of:

suspending the cleanroom filters substantially above openings of the grid matrix and between cross members by placing a peripheral support flange of the cleanroom filters in a track support channel attached at a top side of the cross members;

positioning of a screen below the cleanroom filter;

forming a pressure chamber between the cleanroom filter and the screen;

forming apertures in said cross members;

forcing air through the cleanroom filter and into the pressure chamber, with a resultant airflow passing therefrom into the interior of said cross members via said apertures as well as passing vertically downward through the screen thereby preventing the accumulation of said particulate material in said vortex or dead air space immediately below said cross members; and varying the area of said apertures to vary the flow of the air therethrough into the interior of said cross members.

10. A ceiling structure forming a ceiling within a cleanroom, said ceiling structure including a grid support structure forming a rectangular openings in said ceiling structure and an array of cleanroom filters formed by a plurality of rectangular filters, each rectangular filter of said plurality of rectangular filters having an upper surface, lower surface, and a periphery supported above said rectangular openings formed by said grid support structure of said ceiling structure, said plurality of cleanroom filters filtering air flowing into said cleanroom, said grid support structure comprising:

a grid support structure including a plurality of elongated cross members, each having at least two side walls having, in turn, a plurality of apertures therethrough and having an elongated rectangular shaped interior space;

at least one elongated light fixture disposed within said elongated rectangular shaped interior space of the plurality of elongated cross members;

a gel track integrally associated with the elongated cross member, said gel track being positioned above the light fixture; and each rectangular filter of said plurality of rectangular filters having a peripheral sealing edge located at said lower surface of said rectangular filter, the sealing edge being positioned in the gel track sealingly engaging the gel track to prevent said air flow therethrough wherein said air flows from said plurality of rectangular falters, through said apertures in the side walls of the elongated cross members, through the rectangular cross section of the elongated cross members, around the at least one elongated light located in the rectangular cross section of the elongated cross members, and from the plurality of elongated cross members into said cleanroom.

11. A method for preventing the accumulation of particulate material m a vortex or dead air space immediately below and in the interior cross members forming a grid matrix which supports cleanroom filters above a cleanroom enclosure, said method comprising the steps of:

suspending the cleanroom filters substantially above openings of the grid matrix and between cross members by placing a peripheral support flange of the cleanroom filters in a gel track support channel attached at a top side of the cross members;

positioning of a screen below the cleanroom filter;

forming a pressure chamber between the bottom of the cleanroom filter and the screen;

forming apertures in said cross members;

forcing air through the cleanroom filter and into the collection chamber, with a resultant airflow passing therefrom into the interior of said cross members via said apertures as well as passing vertically downwards through the screen; and varying the area of said apertures to vary the flow of the-air therethrough into the interior of said cross members.

12. A ceiling structure forming a ceiling within a cleanroom, said ceiling structure including a grid support structure forming rectangular openings in said ceiling structure and an army of rectangular cleanroom filters having an upper surface, lower surface, and a periphery supported above said rectangular openings formed by said grid support structure of said ceiling structure, said grid support structure including:

a gel track formed proximate the top of said grid support structure forming said rectangular openings near an interior perimeter of each of the rectangular openings in said grid support structure of said ceiling within said cleanroom;

said rectangular cleanroom filters each including a peripheral flange having a sealing edge extending from substantially adjacent said lower surfaces of each of said rectangular cleanroom filters about said periphery thereof, each of said rectangular cleanroom filters having the sealing edge of the peripheral flange suspended within the gel track;

apertures in said grid support structure for allowing air exiting said rectangular cleanroom filters to flow through said grid support structure into said cleanroom;

one or more elongated lights installed within said grid support structure and allowing air exiting the apertures in said grid support structure to flow therearound and exit said grid support structure;

screen diffuser means located below said bottom surface of each said cleanroom filter of said array of cleanroom filters;

isolation seal means located between each screen diffuser means and grid support structure; and damper means slidably movable within said grid support structure to vary the open area of the apertures in said grid support structure.

* * * * *

UNITED STATES PATENT AND TRADEMARK OFFICE

CERTIFICATE OF CORRECTION

PATENT NO. : 5,620,369
DATED : April 15, 1997
INVENTOR(S) : SPRANSY ET AL.

It is certified that error appears in the above-indentified patent and that said Letters Patent is hereby corrected as shown below:

In column 1, line 5, change "application" (2nd occurrence) to --continuation--;

In column 1, line 6, change "March 20" to --March 22--;

In column 6, line 39, change "diffuses" to --diffusers--;

In column 6, line 48, change "266" to --166--;

In column 6, line 59, change "266 to --166--;

UNITED STATES PATENT AND TRADEMARK OFFICE

CERTIFICATE OF CORRECTION

PATENT NO. : 5,620,369
DATED : April 15, 1997
INVENTOR(S) : SPRANSY ET AL.

It is certified that error appears in the above-identified patent and that said Letters Patent is hereby corrected as shown below:

In column 8, line 8, change "foraged" to --formed--;

In column 8, line 49, after "plurality" insert --of--.

In column 9, line 56, after members delete "of";

In column 10, line 49, change "openings" to --opening--;

In column 11, line 6, change "falters" to --filters--;

In column 11, line 14, delete "m" and insert --in--therefore;

IN THE DRAWINGS:

In FIG. 6, change the right lower wall portions number to --239--;

In FIG. 6, change the upper right sidewall to --241--;

Signed and Sealed this

Sixth Day of January, 1998

*Attest:*

*Attesting Officer*

BRUCE LEHMAN

*Commissioner of Patents and Trademarks*